US008770664B1

(12) United States Patent
Leal

(10) Patent No.: US 8,770,664 B1
(45) Date of Patent: Jul. 8, 2014

(54) RECLINING CHAIR WITH TWO POSITIONS OF REPOSE

(71) Applicant: Daniel Jose Leal, Tampa, FL (US)

(72) Inventor: Daniel Jose Leal, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 14/032,993

(22) Filed: Sep. 20, 2013

(51) Int. Cl.
*A47C 1/00* (2006.01)

(52) U.S. Cl.
USPC ..... 297/344.1; 297/325

(58) Field of Classification Search
USPC ..... 297/271.5, 325, 344.1
See application file for complete search history.

(56) References Cited

U.S. PATENT DOCUMENTS

| | | | | |
|---|---|---|---|---|
| 234,537 | A | 11/1880 | Clough | |
| 375,840 | A | 1/1888 | Stockton | |
| 1,303,994 | A | 5/1919 | Ulmann | |
| 1,525,726 | A | 2/1925 | Falconer | |
| 1,983,206 | A * | 12/1934 | Witzel | 297/270.1 |
| 3,870,364 | A | 3/1975 | Cortina | |
| 3,945,651 | A * | 3/1976 | Boswinkel | 297/337 |
| 4,124,251 | A * | 11/1978 | Petersen | 297/448.1 |
| 4,160,564 | A * | 7/1979 | Kyle | 297/131 |
| 4,595,234 | A | 6/1986 | Kjersem | |
| 5,375,911 | A | 12/1994 | Morrow | |
| 6,206,472 | B1 * | 3/2001 | Waugh | 297/325 |
| 8,313,141 | B2 | 11/2012 | Woodring | |
| 2013/0328367 | A1 * | 12/2013 | Yestadt | 297/239 |

* cited by examiner

*Primary Examiner* — Philip Gabler
(74) *Attorney, Agent, or Firm* — Andriy Lytvyn; Nilay J. Choksi; Smith & Hopen, P.A.

(57) ABSTRACT

A reclining chair having two stable positions of repose: an upright position and a reclined position. The chair having two peripheral supports and multiple intermediate supports disposed between the peripheral supports. Both the peripheral supports and the intermediate supports having integrated legs with three contact areas. In the upright position, only the first and the second contact areas contact the support surface, while in the reclined position only the third contact area contacts the support surface. The chair has a seat, a backrest, and an optional headrest. Armrest supports may be positioned on exterior sides of the peripheral supports to form an armrest and provide additional lateral stability.

18 Claims, 6 Drawing Sheets

RECLINING CHAIR WITH TWO POSITIONS OF REPOSE

BACKGROUND OF THE INVENTION

1. Field of the Invention

The invention relates to chairs. More specifically, it relates to a reclining chair transitionable between upright and tilted positions.

2. Brief Description of the Related Art

Recent technological advances have fundamentally altered the way most humans live their lives. The sedentary lifestyle has become the norm for many students, professionals, and office staff who spend numerous hours sitting in their chairs with very little movement. Sitting in a chair for prolonged periods of time may lead to lower back pain or worsen an existing back problem. Maintaining a static posture, such as sitting, for extended duration increases stress on the back, shoulders, arms and legs, and can add pressure to the back muscles and spinal discs.

A plethora of ergonomic office chairs aimed at reducing the negative impacts of sitting are known in the art. Many chairs have a reclining capability, but most require the users to continuously exert a force on the back support of the chair to maintain the reclined position—as soon as the user stops actively leaning back, the chair returns to its default upright position. Other chairs having an upright and reclined position exist, but they have some serious flaws.

For example, the chair disclosed in U.S. Pat. No. 6,206,472 requires the user to exert sufficient force on the back of the chair to cause the chair to pivot about its hind legs and fall back from its stable upright position. The chair then falls backwards until the auxiliary legs make contact with the floor. The free fall of the chair may cause great discomfort and anxiety for its users. Furthermore, if the user exerts too much force, or if the user has a heavier body, the momentum generated by the falling motion may be so great that the auxiliary legs may be incapable of stabilizing the chair in the reclined position causing the chair to completely flip over possibly inflicting serious bodily injuries.

Another example of a reclining chair is disclosed in U.S. Pat. No. 3,945,651. This chair requires a very bulky mechanism to facilitate the transition from an upright to reclined positions. The bulkiness of the chair makes it impractical for a working environment, such as an office or a library. Difficult transportation, storage, and assembly are other drawbacks of this design. Furthermore, the complexity of the reclining mechanism may become a distraction hindering rather than facilitating productivity.

Accordingly, what is needed is a chair with a simple reclining mechanism that allows the chair to easily and safely transition from an upright position to a reclined position allowing the user to maintain an upright sitting posture while working and then effortlessly recline to a stable reclined position allowing the user to relax and take the pressure off the back muscles and spine.

BRIEF SUMMARY OF THE INVENTION

The long-standing but heretofore unfulfilled need for a reclining chair with a stable upright and reclined positions that is easy to transport and assemble is now met by a novel and non-obvious invention.

The present invention is a chair having two positions of repose. The chair has two peripheral supports and a plurality of medial supports disposed between the peripheral supports. The peripheral supports and the medial supports have integrated legs. The integrated legs having a first, a second, and a third contact areas: in an upright position only the first and the second contact areas contact a support surface, while in the reclined position, only the third contact area contacts the support surface. The third contact area is a contact edge. A seat and a backrest are placed between the two peripheral supports, and both rest on the medial supports.

The chair is stable in both the upright position and the reclined position. In the upright position, the center of gravity is between the first and the second contact areas, while in the reclined position, the center of gravity is aft of the second contact area. The transitioning between the first and the second positions is achievable by shifting the center of gravity.

The chair according to the present invention may further have two armrest supports on exterior sides of the peripheral supports. The armrest supports and peripheral supports collectively form an armrest. The armrest supports also have integrated legs identical to those of the side and medial supports.

The chair may further contain a headrest, which is also positioned between the peripheral supports and rests on the medial supports. The medial supports may contain grooves configured to receive the seat, the backrest, and the headrest. The grooves restrict longitudinal movement of the seat and the backrest, and the peripheral supports restrict lateral movement thereof.

Preferably, between one and five medial supports are used to sufficiently increase the stability and strength of the chair. However, for some applications, more medial supports may be desirable. The medial supports may be equidistantly spaced. Fastener rods may be used to securing together the peripheral supports, the medial supports, and the optional armrest supports.

The peripheral supports and the medial supports may be wooden, plastic, metal, or of any other material exhibiting necessary properties, such as strength, light-weight, durability, etc.

In an embodiment, the integrated legs have a z-shaped path of travel: angling upward from the first contact area toward the second contact area, angling downward to the second contact area, and angling upward from the second contact area toward the trailing edge, wherein all angling portions are substantially straight.

In an alternative embodiment, the rear integrated legs only contain the second and the third contact areas—the first contact areas are positioned on the front legs of the peripheral supports. The rear integrated legs have a triangular shape, where one of the sides of the triangle is the third contact area, which is essentially a contact edge.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1A:
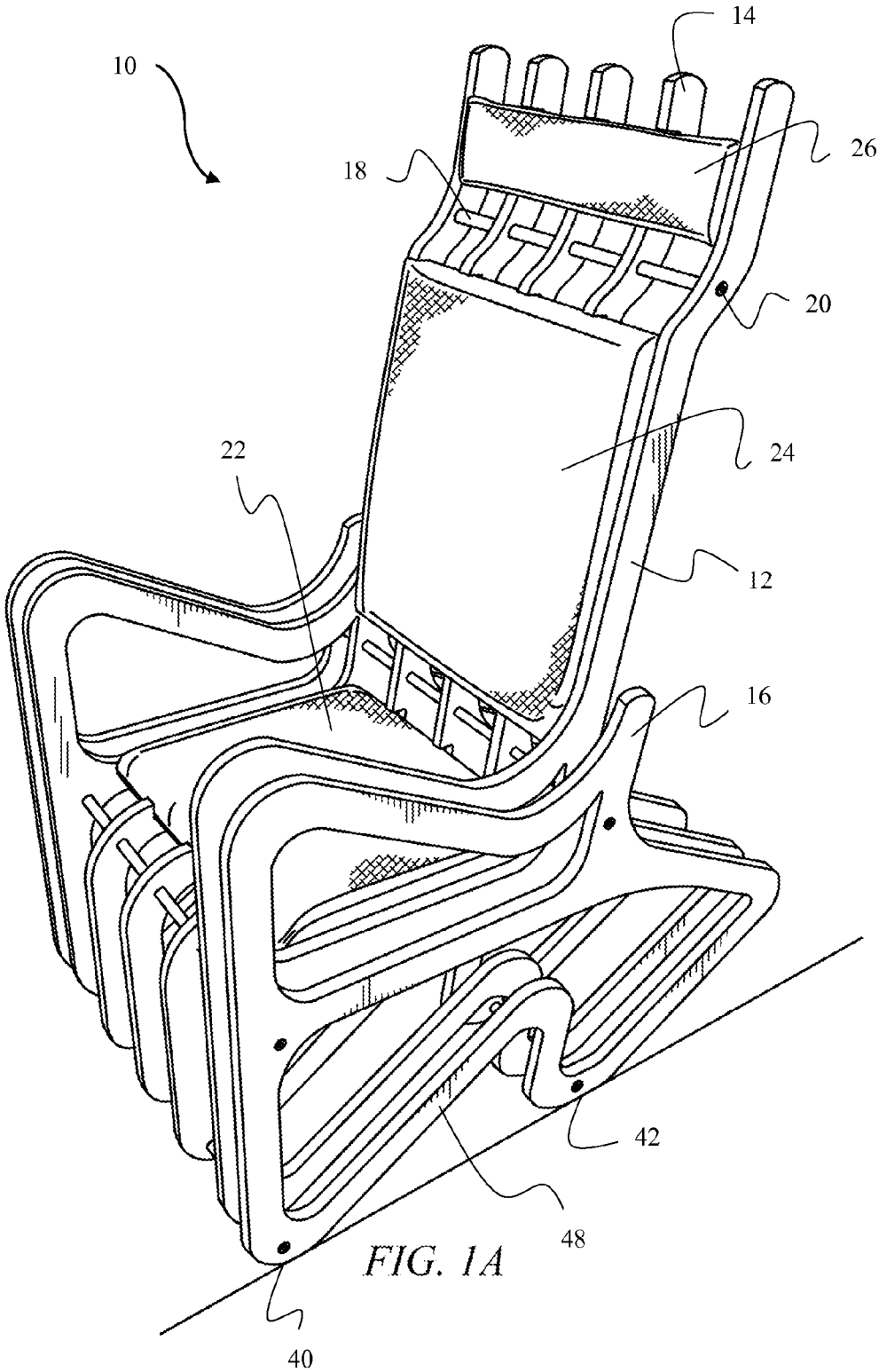
FIG. 1A is a perspective view of the reclining chair in an upright position.
Figure 1B:
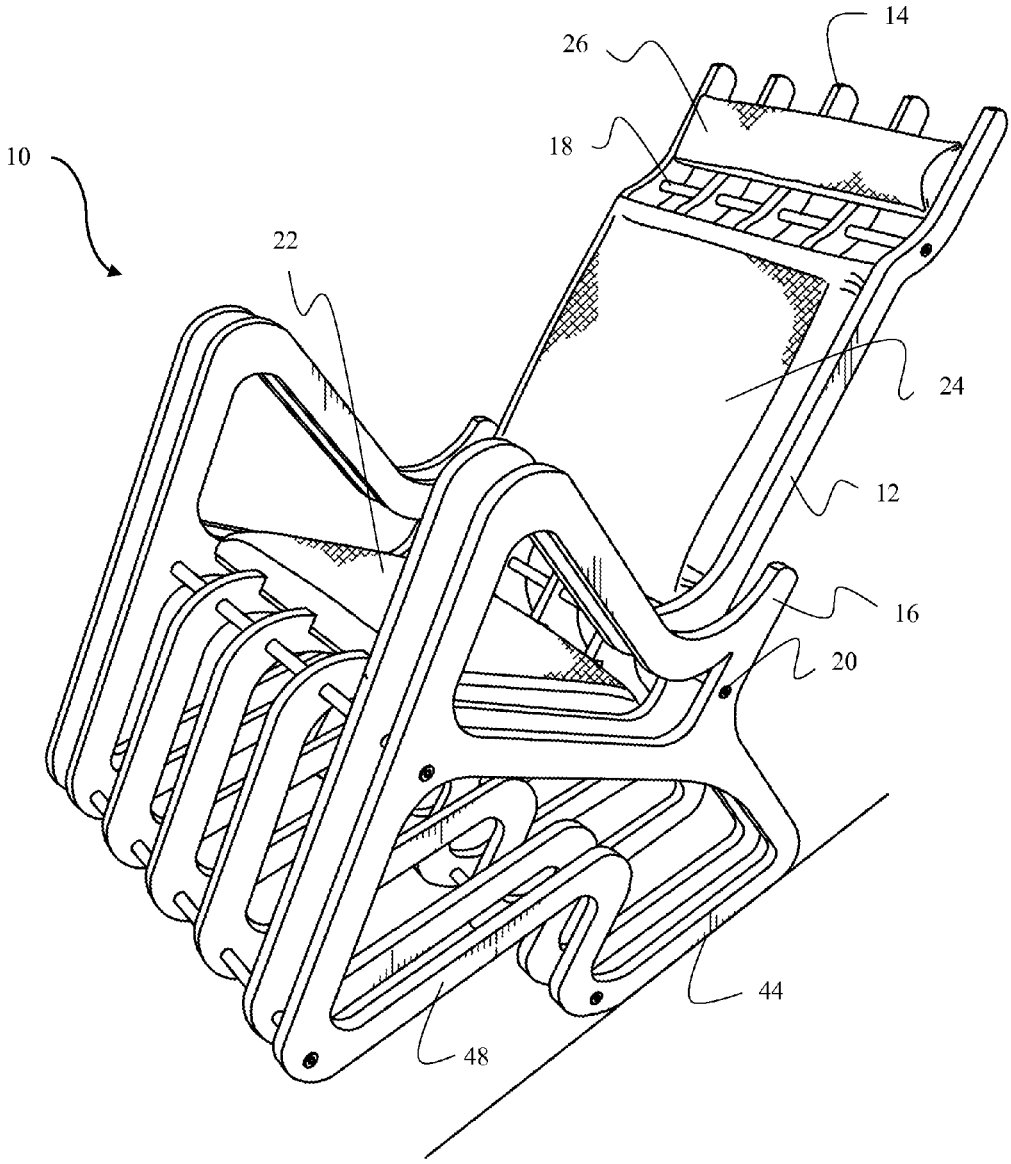
FIG. 1B is a perspective view of the reclining chair in a reclined position.

FIGS. 1A-B depict a reclining chair 10 according to the present invention. Reclining chair 10 is characterized by that it comprises a plurality of medial supports 14 disposed between two peripheral supports 12. Optional armrest supports 16 may be disposed on both sides of reclining chair 10. The contours of the lower portions of peripheral supports 12, medial supports 14, and armrest supports 16 are identical. This feature of reclining chair 10 facilitates efficient machining of all support components, compact packaging, and easy assembly. These advantages constitute a significant advancement over the current state of the art because they can reduce the overall cost of the product, while increasing its appeal due to simplified shipping and storage options.

Each peripheral support 12, medial support 14, and armrest support 16 is separated from adjacent support components by spacers 18. Fastening rods 20 pass through spacers 18 and the pre-drilled holes 21 in the support components 12, 14, and 18 securing them together. A headrest 26, a back cushion 24, and a seat cushion 22 are placed between peripheral supports 12 and rest in dedicated grooves in middles supports 14.

In an exemplary embodiment, shown in FIGS. 1 and 2, five fastening rods 20 are inserted in the following locations: near a front contact point 40, near rear contact point 42, and three fastening rods 20 between seat cushion 22, back cushion 24, and headrest 26. These locations are preferred because they are subjected to the greatest stresses, and additional reinforcement provided by fastening rods 20 enables reclining chair 10 to better withstand those stresses.

Figure 2A:
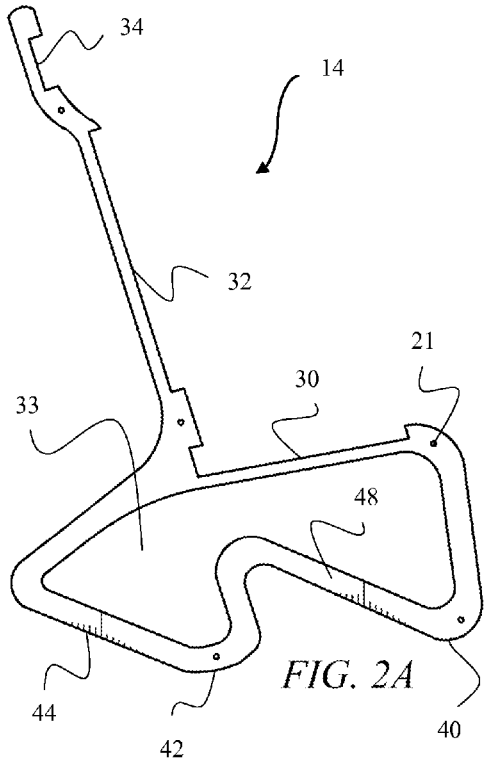
FIG. 2A is a side view of a medial support component of the reclining chair.
Figure 2B:
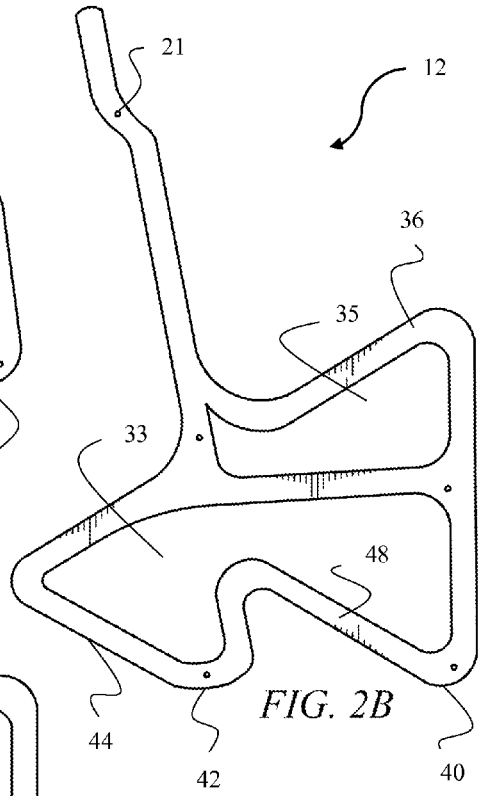
FIG. 2B is a side view of a peripheral support component of the reclining chair.
Figure 2C:
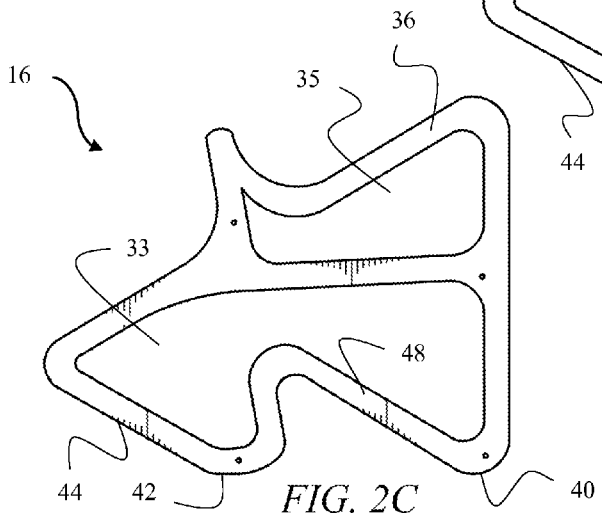
FIG. 2C is a side view of the armrest support component of the reclining chair.

The structural configurations of peripheral supports 12, medial supports 14, and armrest supports 16 are illustrated in FIGS. 2A-C. Referring to FIG. 2A, medial supports 14 have grooves 30, 32, and 34 adapted to receive seat cushion 22, back cushion 24, and headrest 26 respectively. Grooves 30, 32, and 34 secure cushions 22, 24, and 26 restricting them from sliding longitudinally along the frames of medial supports 14. In an embodiment, the cushions may be further secured to medial supports 14 via adhesive or any fastening means known in the art.

Peripheral supports 12 are shown in FIG. 2B. Peripheral supports 12 have a similar frame structure as medial supports 14 with two differences: first, peripheral supports 12 do not contain any grooves, and second, they include an armrest 36. Since peripheral supports 12 do not contain grooves 30, 32, and 34, the frame of peripheral supports 12 abuts seat cushion 22, back cushion 24, and headrest 26 restricting their later movement, thereby further securing them in place. Armrest 36 is configured to allow the users of reclining chair 10 to place their arms onto the armrests 36 to facilitate comfort. In a preferred embodiment, armrest 36 is angled in a way that provides the most comfort to the user in both the upright and reclined positions.

Armrest supports 16 are depicted in FIG. 2C. The main purpose of these optional components is to provide additional support for the user's arms and lateral stability to reclining chair 10. Armrest supports 16 allow for reduction of thickness of peripheral supports 12, while providing the user with an armrest of a comfortable width. An armrest cushion (not shown in the figures) may be placed onto armrest 36 and armrest support 16 to provide further comfort. Another function of armrest supports 16 is to increase lateral stability of reclining chair 10 by extending its width without affecting the height, thereby lowering its center of gravity. This feature reduces the risk of reclining chair 10 tipping over on its side, especially as the center of gravity shifts during transitioning between the upright and reclined positions.

FIG. 2A shows the medial support 14 having a lower cutout 33, and FIGS. 2A and 2B show peripheral supports 12 and armrest supports 16 having lower cutouts 33 and upper cutouts 35. The cutouts reduce the amount of material required and overall weight of reclining chair 10, while maintaining adequate structural strength. In a preferred embodiment, lower cutouts 33 are identical for all supports, and upper cutouts 35 on peripheral supports 12 are identical to upper cutouts 35 on armrest supports 16. This feature reduces the machining cost and improves nesting, therefore allowing for more compact packaging and storage. Preferably, lower and upper cutouts 33 and 35 have smooth corners to increase the structural integrity by eliminating the points of concentrated stress.

Unlike most conventional chairs, reclining chair 10 does not have distinct front and rear legs. Instead, integrated legs 48 shown in FIGS. 1 and 2 allow each support to transition from two points of contact 40 and 42 in the upright position to a single contact edge 44 in the reclined position. This feature allows reclining chair 10 to be stable in both the upright and the reclined positions. The curvature of integrated legs 48 facilitates smooth transition between the upright and reclined positions, therefore, increasing stability and reducing the risk of tipping over.

By eliminating conventional vertical front and rear legs, concentrated stresses and moments at the points where the legs attach to the horizontal frame members are reduced, thus making reclining chair 10 much stronger and safer than conventional chairs known in the art. Inclusion of multiple medial supports 14 further strengthens reclining chair 10 making it less susceptible to breaking under heavy loads.

Integrated legs 48 of peripheral supports 12, medial supports 14, and armrest support 16 are designed so that when the user is sitting in the upright position the center of gravity is fore of rear contact point 42. This creates a moment about the rear contact point 42 that urges reclining chair 10 toward upright position where front contact point 40 engages the ground, therefore, stabilizing reclining chair 10 in the upright position. When the user leans back, the center of gravity shifts backwards. Once the center of gravity is aft contact point 42, an opposite moment is created urging reclining chair 10 to tilt backwards until contact edge 44 engages the support surface. In the reclined position, the pressure exerted by reclining chair 10 on the support surface is distributed over the entire contact edge 44 of medial supports 14 and peripheral supports 12. Due to this aspect of the invention, shifting the center of gravity both laterally and longitudinally in the reclined position does not destabilize reclining chair 10. This allows the user to move around in the seat when reclining chair 10 is in the reclined position to achieve a comfortable position without a serious risk of tipping over. Furthermore, distribution of forces over the entire contact edge 44 of every support component significantly reduces the risk of mechanical failure, thus making reclining chair 10 very safe even for the users with heavy body types. The stability and strength of reclining chair 10 is further enhanced by the plurality of medial supports 14 simultaneously contacting the ground.

Figure 3A:
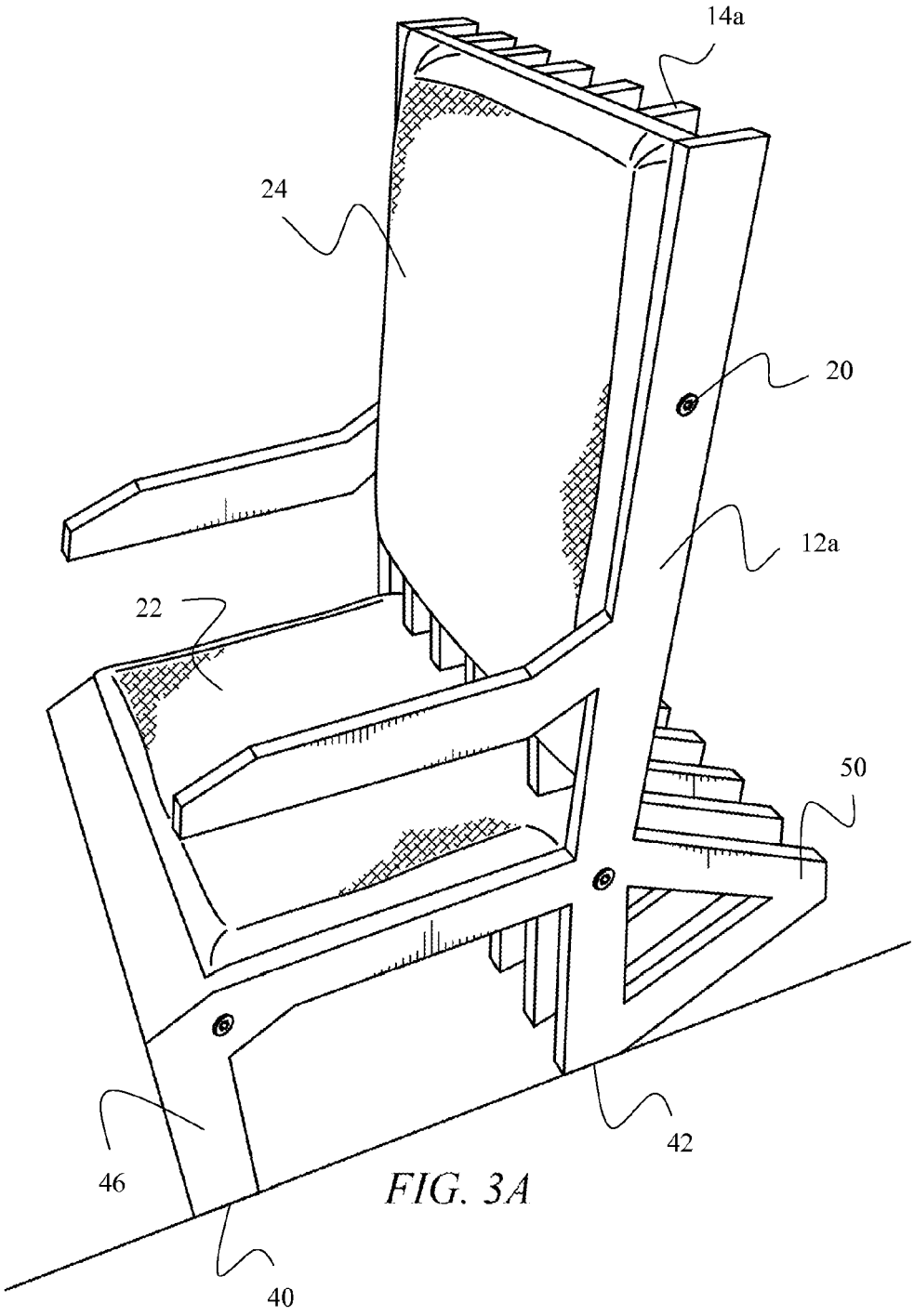
FIG. 3A is perspective view of an alternative embodiment of the reclining chair in the upright position.
Figure 3B:
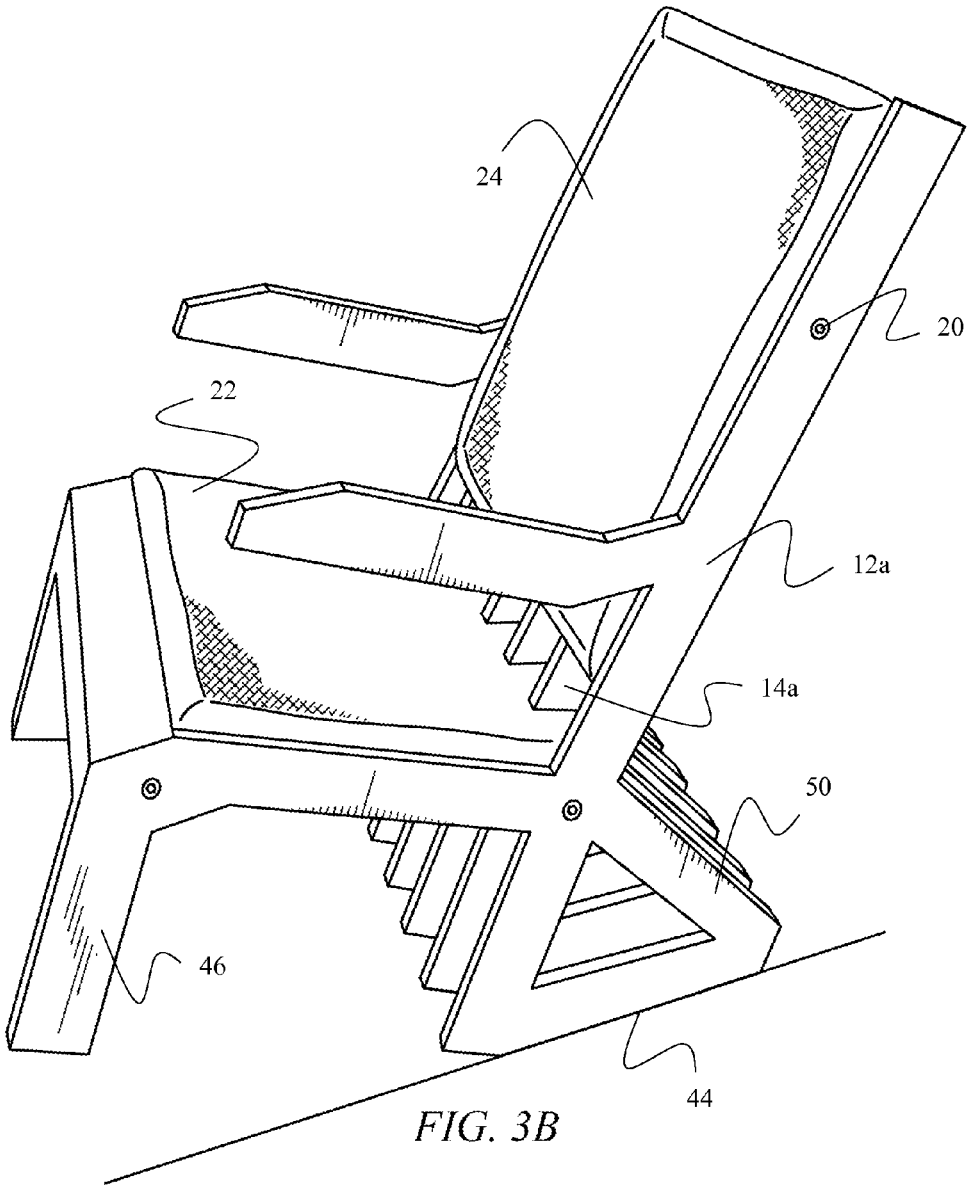
FIG. 3B is perspective view of the alternative embodiment of the reclining chair in the reclined position.
Figure 3C:
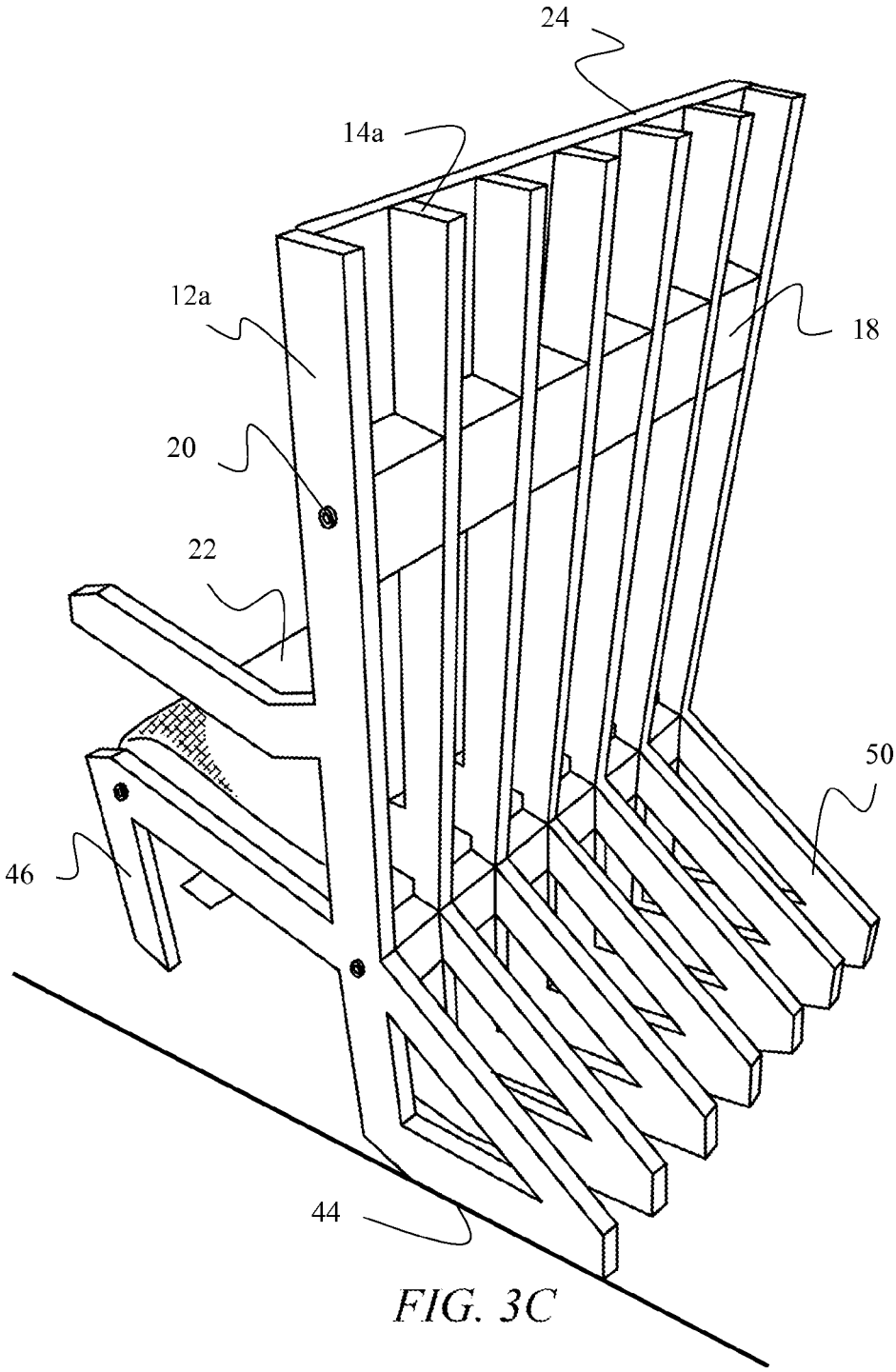
FIG. 3C is a perspective view of the back of the alternative embodiment of the reclining chair.

FIGS. 3A-C show an alternative embodiment of the invention. Similar to the embodiment depicted in FIGS. 1 and 2, reclining chair 10*a* includes two peripheral supports 12*a* and a plurality of medial supports 14*a* disposed between peripheral supports 12*a*. Spacers 18 are inserted between adjacent medial supports 14*a*, and fastening rods 20 are inserted through the predrilled holes 21 of peripheral supports 12*a*, medial supports 14*a*, and spacers 18 securing these components together in a single structure. Seat cushion 22 and back cushion 24 may be disposed between peripheral supports 12*a*.

Unlike the embodiment of FIGS. 1 and 2, in which all support components only have integrated legs, peripheral supports 12*a* have conventional front legs 46 and rear integrated legs 50, while the medial supports only have rear integrated legs 50. When reclining chair 10*a* is in the upright position depicted in FIG. 3A, front legs 46 and rear integrated legs 50 contact the support surface making front and rear contact points 40 and 42 respectively. When reclining chair 10*a* is transitioned into a reclined position, only the rear integrated legs 50 contact the support surface along contact edges 44. As discussed above, this feature increases stability and strength of the chair. This more compact embodiment requires less material, thus reducing the cost of manufacturing, packaging, storing, and transporting, while still providing increased stability and strength in the reclined position.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

GLOSSARY OF CLAIM TERMS

Armrest—a part of a chair adapted to support a user's arm.

Armrest support—a support component positioned on lateral extremities of a chair; the lower portion of the armrest support is an integrated leg and the upper portion is adapted to support a user's arm.

Backrest—a part of a chair adapted to support a user's back.

Center of gravity—a point through which the weight of a chair can be assumed to act when considering forces on the chair and the motion thereof under gravity.

Contact area—a surface of a chair leg that comes into direct contact with the supporting surface on which the chair is positioned.

Contact edge—a contact area having an elongated substantially rectangular shape.

Fastener rod—a rigid elongated member with a threaded end.

Groove—an elongated slot adapted to receive and at least partially restrict movement of a component.

Headrest—a part of a chair adapted to support a user's head.

Integrated leg—a monolithic lower portion of a chair coming in contact with a support surface adapted to withstand compressive forces exerted by the weight of the chair and a user; a single integrated leg performs the functions of a front leg, a rear leg, and an axillary leg.

Integrated rear leg—a monolithic lower portion of a chair located near the trailing edge of the chair and coming in contact with a support surface; a single integrated rear leg performs the function of a rear leg and an auxiliary leg allowing the chair to have a stable reclined position.

Medial support—a support component positioned between two peripheral supports and adapted to support a seat, backrest, and headrest Peripheral support—a support component positioned on either side of at least one medial support.

Position of repose—a distinct configuration of a chair in which it is stable, i.e. upright and reclined positions.

Seat—a part of a chair adapted to support a user's buttocks

What is claimed is:

1. A chair having two positions of repose, comprising:

two peripheral supports, at least one medial support disposed between the peripheral supports in a parallel alignment therewith, the peripheral supports and the medial support having integrated legs, each integrated leg having a first, a second, and a third contact areas, the first and the second contact areas being separated by a longitudinally extending gap, wherein in the first position of repose, the first and the second contact areas together form sole points of engagement between the chair and a support surface, and in a second position of repose, the third contact area is the sole point of engagement between the chair and the support surface, the chair being stable in both the first and the second positions of repose; and a seat and a backrest disposed between the two peripheral supports, the seat and the backrest resting on the medial support;

whereby in the first position of repose, a center of gravity is between the first and the second contact areas, and in the second position of repose, the center of gravity is aft the second contact area, transitioning between the first and the second positions of repose is achievable by shifting the center of gravity.

2. A chair according to claim 1, further comprising:

two armrest supports disposed on exterior sides of the peripheral supports, the armrest supports and peripheral supports collectively forming an armrest, the armrest supports having the integrated legs with three contact areas.

3. A chair according to claim 1, further comprising:

A headrest disposed between the two peripheral supports and resting on the medial supports.

4. A chair according to claim 1, wherein the medial supports contain grooves configured to receive the seat and the backrest, the grooves restricting longitudinal movement of the seat and the backrest, and the peripheral supports restricting lateral movement thereof.

5. A chair according to claim 1, wherein the chair has between one and seven medial supports.

6. A chair according to claim 1, wherein the medial supports are equidistantly spaced.

7. A chair according to claim 1, further comprising a plurality of fastener rods securing together the peripheral supports and the medial supports.

8. A chair according to claim 1, wherein the peripheral supports and the medial supports are wooden or plastic.

9. A chair according to claim 1, wherein the third contact area is a contact edge.

10. A chair according to claim 1, wherein the integrated legs have a path of travel angling upward from the first contact area toward the second contact area, angling downward to the second contact area, and angling upward from the second contact area toward a trailing edge of the chair, all angling portions being substantially straight.

11. A chair having two positions of repose, comprising:

two peripheral supports, each peripheral support having a front leg;

a plurality of medial supports disposed between the peripheral supports in a parallel alignment therewith, the peripheral supports and the medial supports having integrated rear legs, each integrated rear leg having a first and a second contact areas, wherein a first position of repose, the front legs and the first contact area of the rear legs together form sole points of engagement between the chair and a support surface, and in a second position of repose, the second contact area of the rear legs is the sole point of engagement between the chair and the support surface, the chair being stable in both the first and the second positions of repose; and a seat and a backrest disposed between the two peripheral supports, the seat and the backrest resting on the medial supports;

whereby in the first position of repose, a center of gravity is between the front legs and the first contact area of the rear legs, and in the second position of repose, the center of gravity is aft the first contact area of the rear legs, the transitioning between the first and the second positions of repose is achievable by shifting the center of gravity.

12. A chair according to claim 11, wherein the medial supports contain grooves configured to receive the seat and the backrest, the grooves restricting the longitudinal movement of the seat and the backrest, and the peripheral supports restricting the lateral movement thereof.

13. A chair according to claim 11, wherein the chair has between one and five medial supports.

14. A chair according to claim 11, wherein the medial supports are equidistantly spaced.

15. A chair according to claim 11, further comprising a plurality of fastener rods securing together the peripheral supports and the medial supports.

16. A chair according to claim 11, wherein the peripheral supports and the medial supports are wooden or plastic.

17. A chair according to claim 11, wherein the second contact area is a contact edge.

18. A chair according to claim 11, wherein the rear integrated legs have triangular shape with one side of the triangle being the third contact area.

* * * * *